US012239915B1

(12) United States Patent
Zhong

(10) Patent No.: US 12,239,915 B1
(45) Date of Patent: Mar. 4, 2025

(54) ROTATABLE PUZZLE BOARD

(71) Applicant: Fengsheng Zhong, Nanning (CN)

(72) Inventor: Fengsheng Zhong, Nanning (CN)

( * ) Notice: Subject to any disclaimer, the term of this patent is extended or adjusted under 35 U.S.C. 154(b) by 0 days.

(21) Appl. No.: 18/767,057

(22) Filed: Jul. 9, 2024

(30) Foreign Application Priority Data

Jul. 2, 2024 (CN) ..... 202421547630.6

(51) Int. Cl.
*A63F 9/10* (2006.01)

(52) U.S. Cl.
CPC ..... *A63F 9/1044* (2013.01)

(58) Field of Classification Search
CPC ..... B65D 2519/0084; A47B 49/004; A47B 63/062; A47B 2063/005; A47B 2220/0011; A63F 9/1044
See application file for complete search history.

(56) References Cited

U.S. PATENT DOCUMENTS 1,859,352 A * 5/1932 Albee ..... A47G 7/041 384/615
2014/0096575 A1* 4/2014 Winig ..... A47F 7/0243 70/62
2023/0347235 A1* 11/2023 Zhou ..... A47B 88/906
2023/0390633 A1* 12/2023 Che ..... A63F 9/1044

* cited by examiner

*Primary Examiner* — Matthew W Ing
(74) *Attorney, Agent, or Firm* — JEEN IP LAW, LLC

(57) ABSTRACT

A rotatable puzzle board is provided, which includes a puzzle board. One side of the puzzle board is provided with a rotatable base, the rotatable base includes a support plate, a contact component, and a support component. The support plate is provided with a contact component socket, and the contact component includes a contact plate. One side of the contact plate extends downwards with a rotation shaft, which is located in the contact component socket. The contact plate is contacted with the puzzle board, the contact component is rotatably connected to the support plate. The support component is located on the support plate, and the support component includes a support seat and a rotating ball located on the support seat and can rotate at any angle. The rotating ball is contacted with the puzzle board, a user can complete puzzles at various angles on the puzzle board without moving.

7 Claims, 13 Drawing Sheets

ROTATABLE PUZZLE BOARD

CROSS-REFERENCE TO RELATED APPLICATIONS

This application claims priority to Chinese Patent Application No. 202421547630.6, filed on Jul. 2, 2024, which is hereby incorporated by reference in its entirety.

TECHNICAL FIELD

The present disclosure relates to the field of jigsaw puzzle technologies, and in particular, to a rotatable puzzle board.

BACKGROUND

Puzzle is one of the most popular board games designed over years and usually played by individuals alone. As is well known, the puzzle is beneficial to brain. Research has shown that playing puzzles can improve cognitive and visual spatial reasoning abilities, as well as train attention and patience. Besides to being a means of entertainment and enjoyment, players also want to challenge themselves by playing puzzles with more blocks. Generally speaking, the more the number of blocks, the more difficult the puzzle becomes. However, a common drawback or burden for the players is that a final size of the puzzle is relatively large. For example, the finished size of a puzzle with 1000 pieces is approximately "30×24", the finished size of a puzzle with 5000 pieces is approximately "60×40", and so on. In other words, these puzzles require a relatively large puzzle board, such as a table or the surface of the puzzle board, in order to piece all the puzzles together to form a puzzle shape. When using a larger puzzle board for puzzles, it is necessary to constantly rotate and move the puzzle board or move around edges of the board to place the puzzle blocks from various angles on the puzzle board. The existing puzzle method causes inconvenience for a user.

SUMMARY

The present disclosure provides a rotatable puzzle board designed to address the shortcomings of the existing technology, which includes a puzzle board, one side of the puzzle board is provided with a rotatable base, and the rotatable base includes:

- a support plate provided with a contact component socket;
- a contact component including a contact plate, one side of the contact plate extends downwards with a rotation shaft, the rotation shaft is located in the contact component socket, the contact plate in contacted with the puzzle board, and the contact component in rotatably connected to the support plate;
- a support component, where the support component is located on the support plate and includes a support seat and a rotating ball located on the support seat and be capable of rotating at any angle, and the rotating ball is contacted with the puzzle board.

In an embodiment of the present disclosure, a bearing installation hole is provided on the support board, and a bearing is provided in the bearing installation hole; the rotation shaft on the contact board passes through the bearing and is fixed in the contact component socket.

In an embodiment of the present disclosure, an anti-slip block is provided on the contact plate, and the anti-slip block is located on one side of the contact plate that contacts with the puzzle board.

In an embodiment of the present disclosure, one side of the support seat is provided with an installation plate, and the support plate is provided with a through hole; the support seat is fixedly connected to the support plate through the installation plate, and the rotating beads pass through the through hole and come into contact with the puzzle board.

In an embodiment of the present disclosure, the puzzle board includes a frame and a support frame provided within the frame, where the support frame includes a plurality of support frame units that are detachable connected, where the support frame units are provided with a clamp block and a clamp slot, and adjacent support frame units are detachably connected through the clamp block in conjunction with the clamp slot.

In an embodiment of the present disclosure, a plurality of drawer boards are provided between the frame and the support frame, and a side of each drawer board is provided with a drawer board positioning groove; the support frame is provided with a drawer board positioning block, and the frame is provided with a suction hole configured to draw the drawer boards.

In an embodiment of the present disclosure, the frame includes a first side rod and a second side rod, where the first side rod and the second side rod are detachably connected to form a closed frame.

In an embodiment of the present disclosure, the first side rod and the second side rod are connected in an insertion manner, and the support frame units are inserted into the frame.

In an embodiment of the present disclosure, an inner side of the frame is provided with a support frame insertion hole, and a connection end between the support frame and the frame is provided with a support frame insertion rod; two sides of the support frame insertion rod are provided with a locking block, and a compression notch is provided on the support frame insertion rod; when the support frame is fixed on an inner side of the frame, the support frame insertion rod is inserted into the support frame insertion hole.

In an embodiment of the present disclosure, a center end of the support frame is provided with a ring frame, and a support frame connection rod is provided between the ring frame and four corners of the frame.

The beneficial effect of the present disclosure is that a rotatable puzzle board is provided, which includes a puzzle board, one side of the puzzle board is provided with a rotatable base, the rotatable base includes a support board, a contact component, and a support component. The support board is provided with a contact component socket, and the contact component includes a contact board. One side of the contact component extends downwards with a rotation shaft, the rotation shaft is located in the contact component socket. The contact board contacts with the puzzle board, and the contact component is rotatably connected to the support board. The support component is located on the support board, and the support component includes a support seat and a rotating ball located on the support seat and can rotate at any angle. The rotating ball contacts the puzzle board. The technical solution provides a contact component that is rotationally connected on the support board, and the contact component is connected to the puzzle board so that the puzzle board is rotatably connected to the support plate, a user can adjust the position of the puzzle board at any time and can complete puzzles at various angles on the puzzle board without moving, rendering it convenient to use.

BRIEF DESCRIPTION OF DRAWINGS

In order to provide a clearer explanation of the embodiments of the present disclosure or the technical solutions in the prior art, a brief introduction will be given below to the accompanying drawings required in the embodiments or prior art description. It is obvious that the accompanying drawings in the following description are only some embodiments of the present disclosure. For those skilled in the art, other accompanying drawings can be obtained based on the structures shown in these drawings without creative work.

Figure 1:
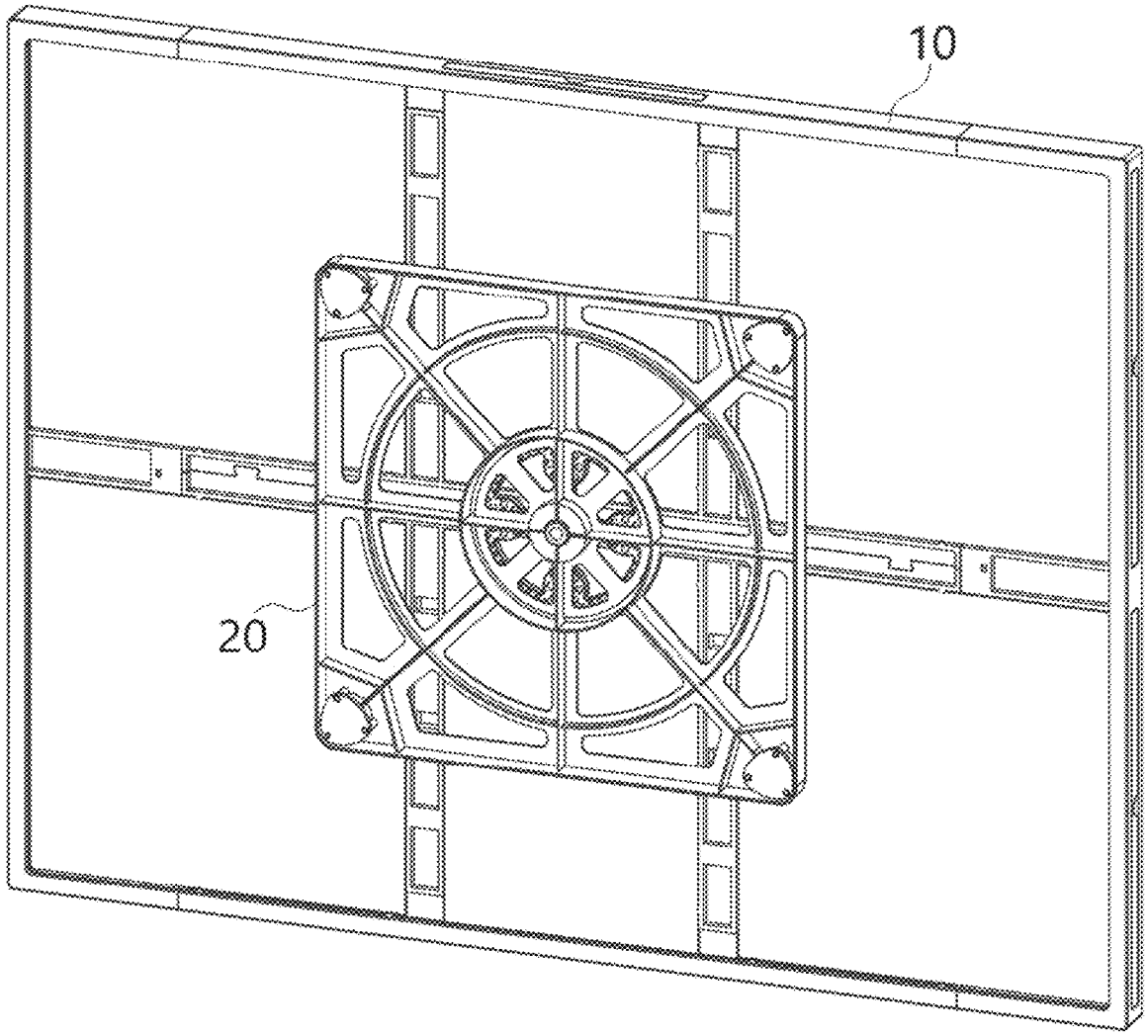
FIG. 1 is a three-dimensional view of a rotatable puzzle board of the present disclosure.
Figure 2:
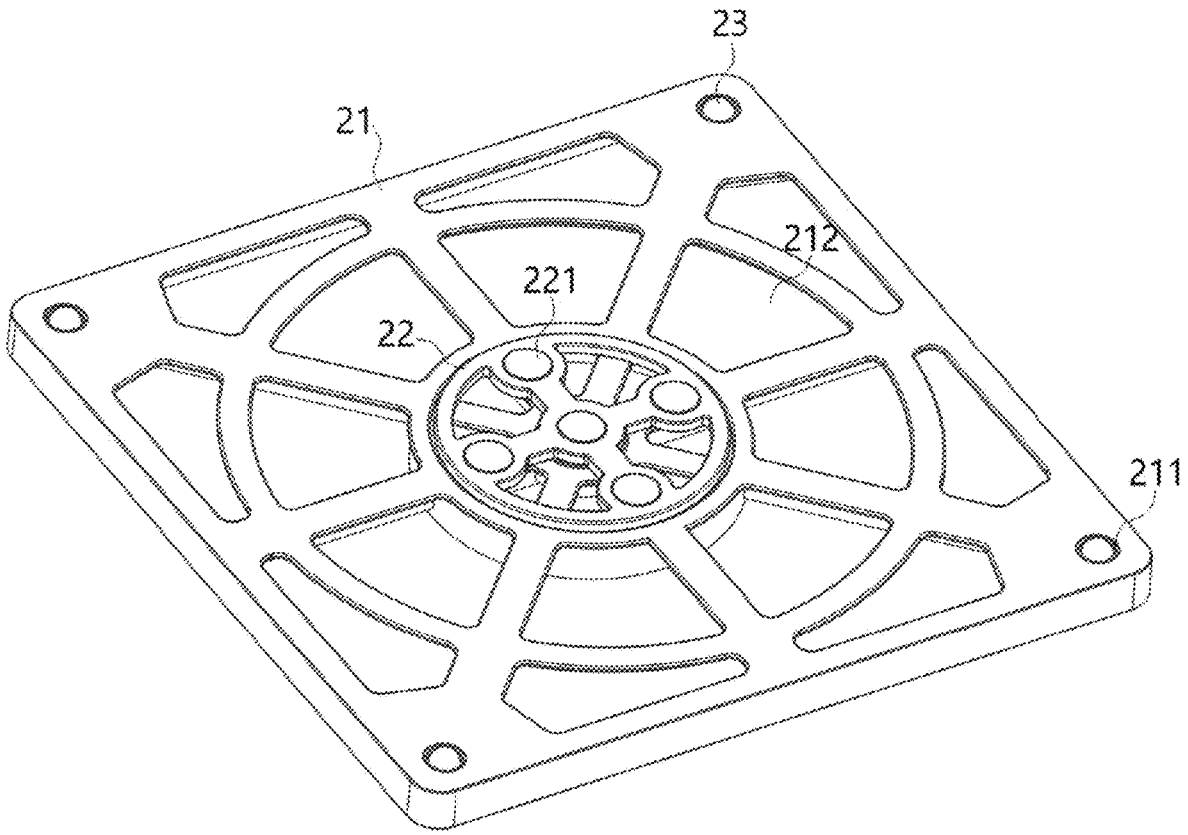
FIG. 2 is a first three-dimensional view of a rotatable base in the rotatable puzzle board of the present disclosure.
Figure 3:
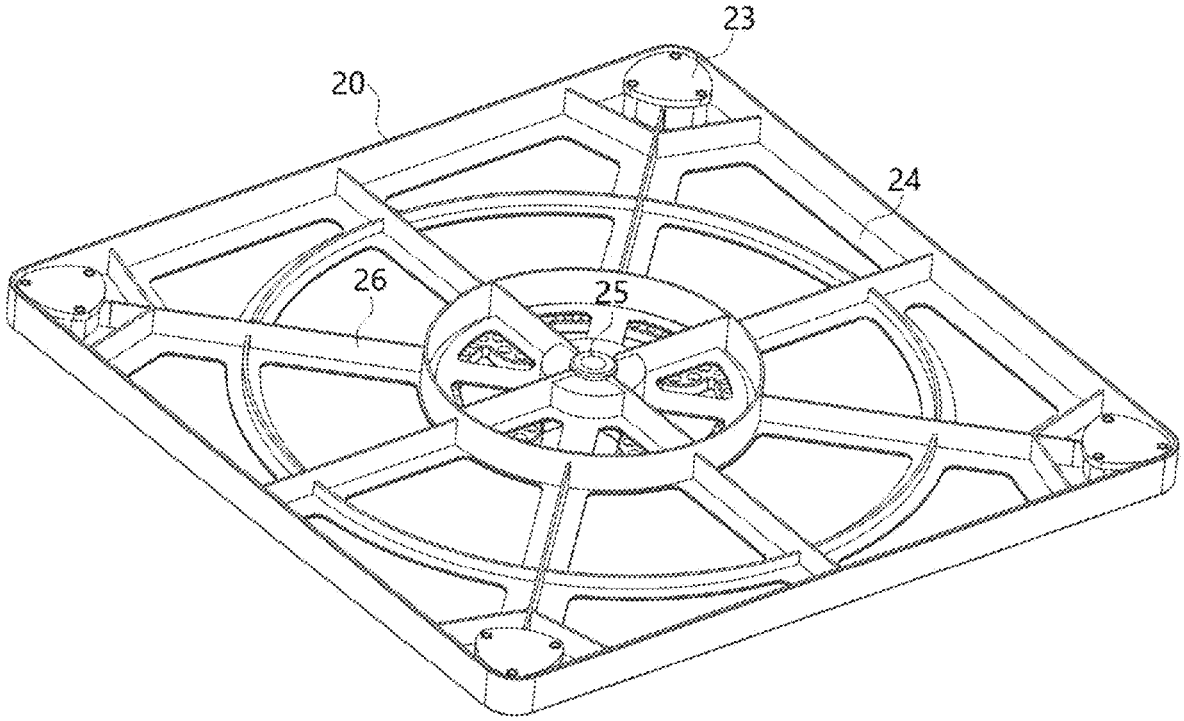
FIG. 3 is a second three-dimensional view of the rotatable base in the rotatable puzzle board of the present disclosure.
Figure 4:
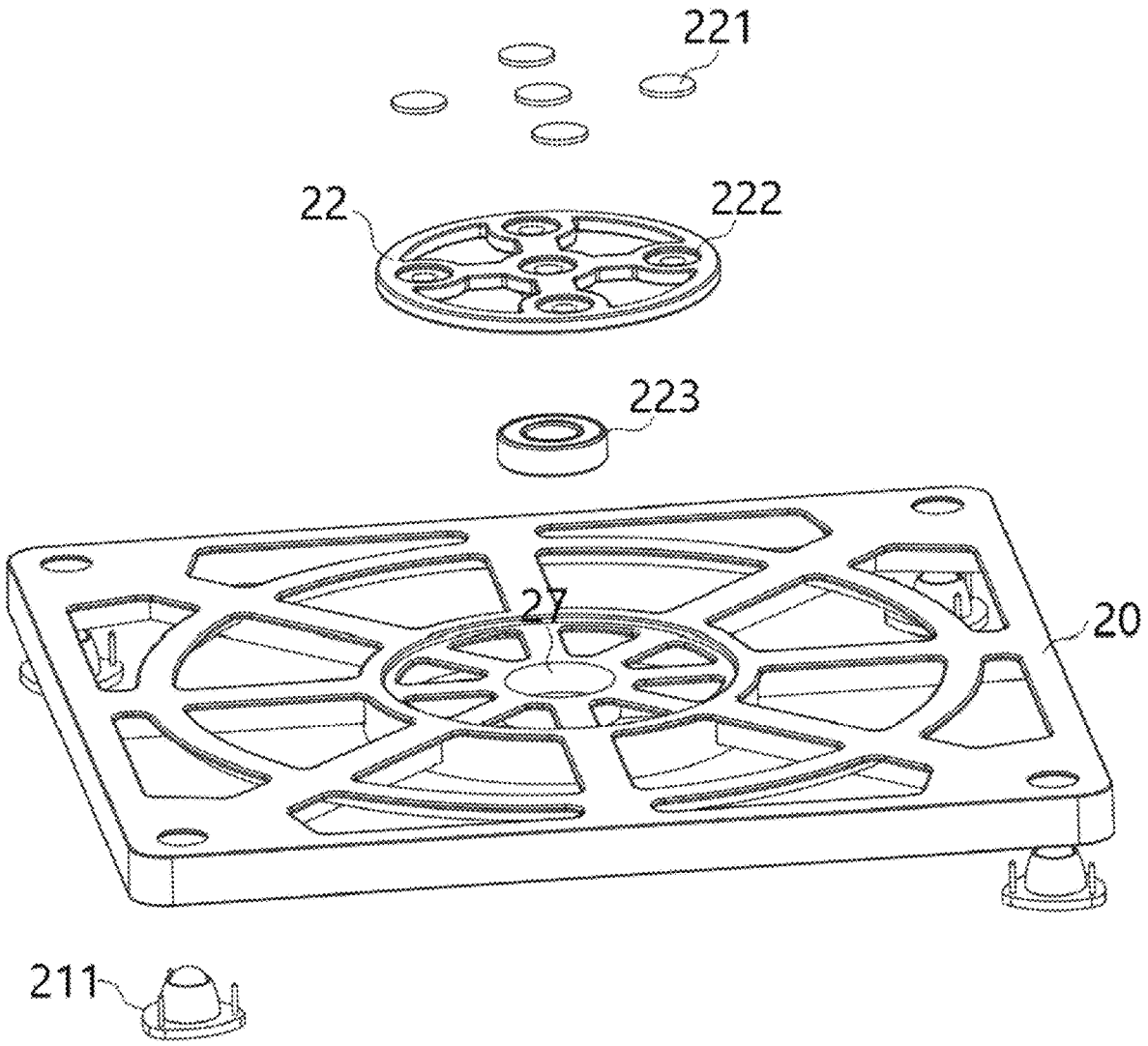
FIG. 4 is an exploded view of the rotatable base in the rotatable puzzle board of the present disclosure.
Figure 5:
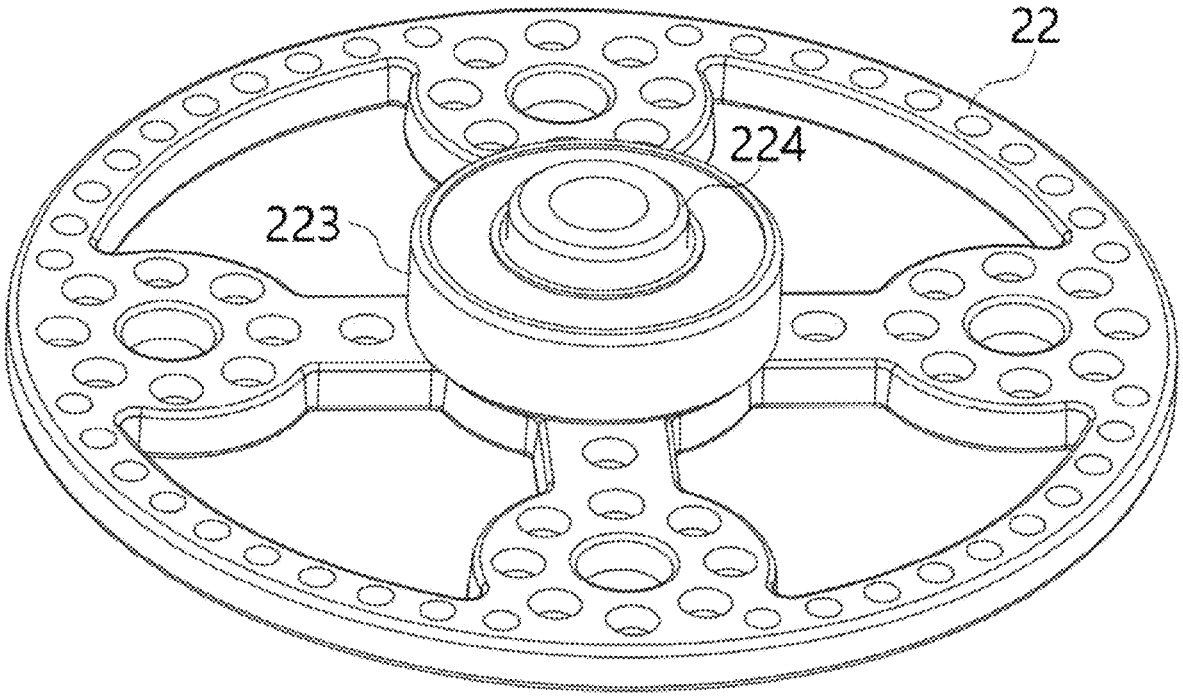
FIG. 5 is a three-dimensional view of a contact component in the rotatable base.
Figure 6:
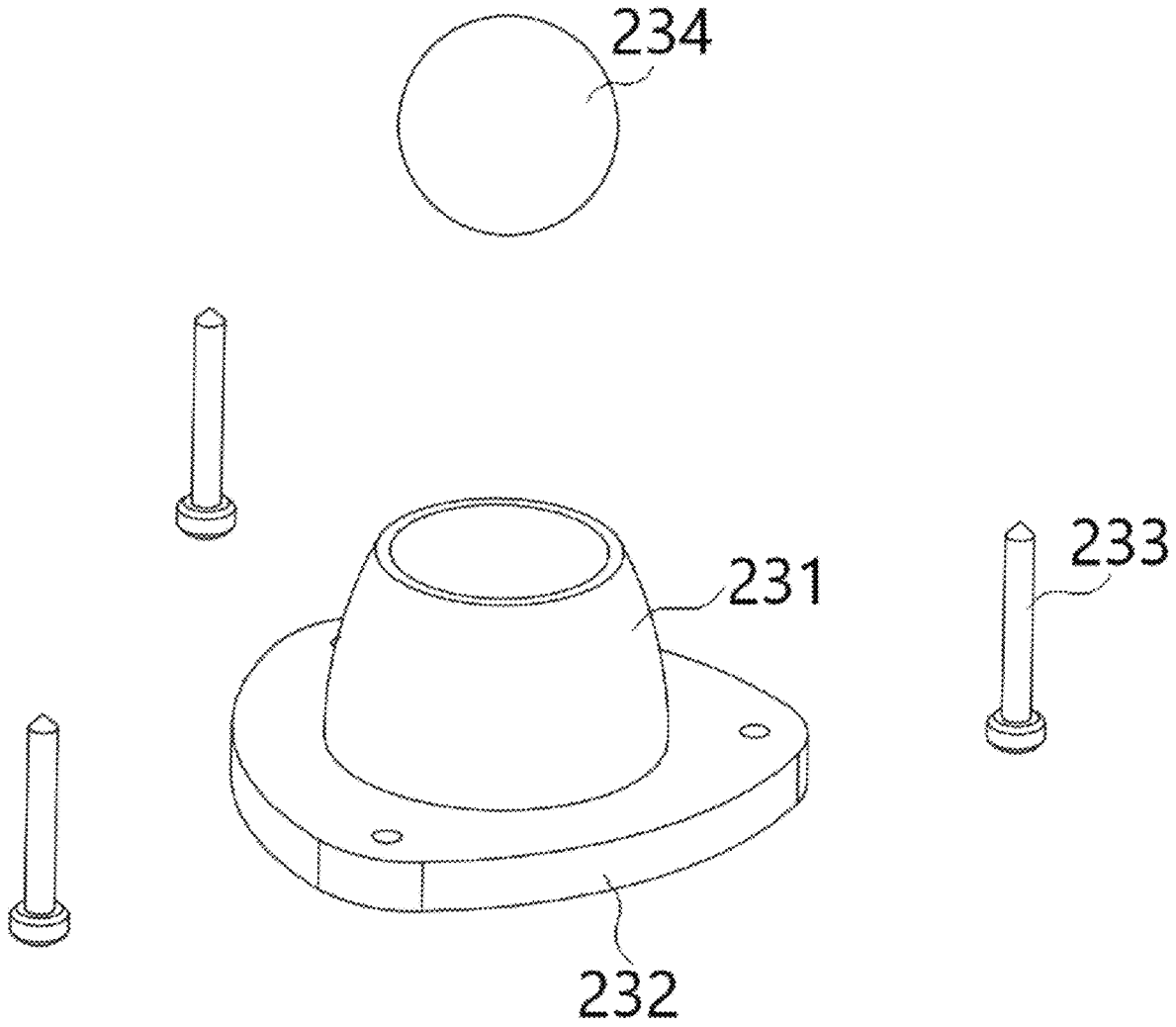
FIG. 6 is an exploded view of a support component in the rotatable base.
Figure 7:
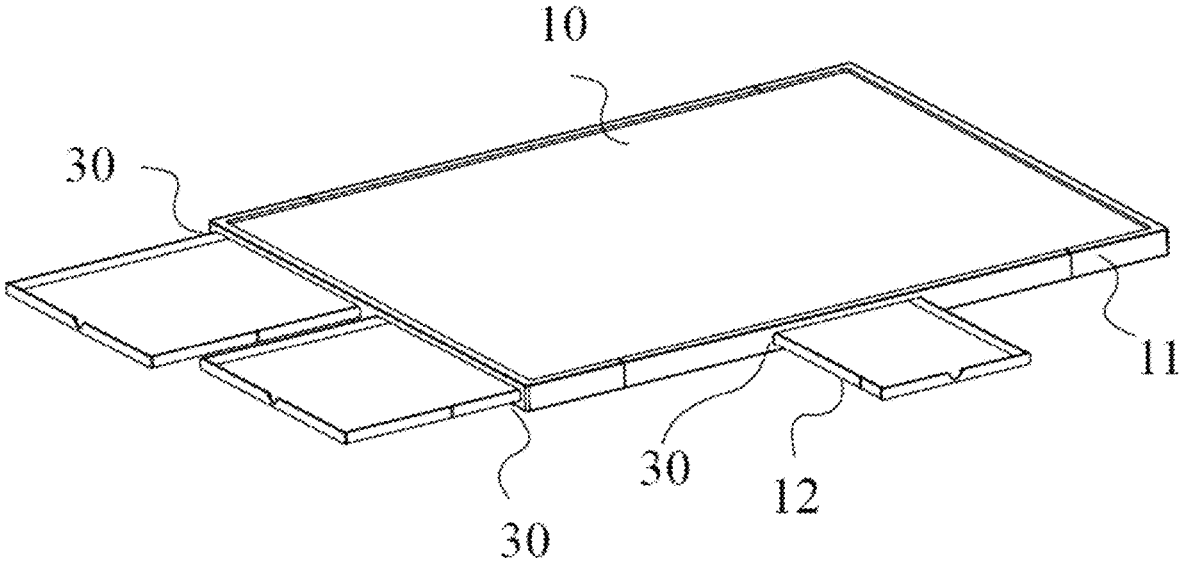
FIG. 7 is a first three-dimensional view of a puzzle board in the rotatable puzzle board of the present disclosure.
Figure 8:
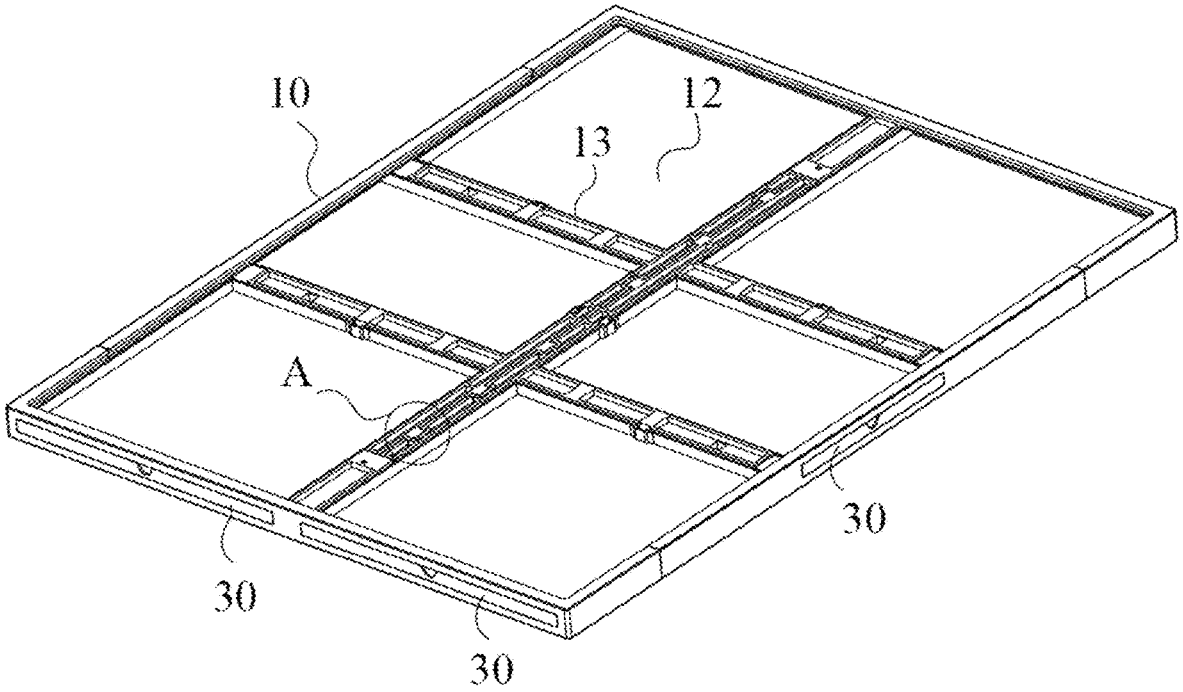
FIG. 8 is a second stereoscopic view of the puzzle board in the rotatable puzzle board of the present disclosure.
Figure 9:
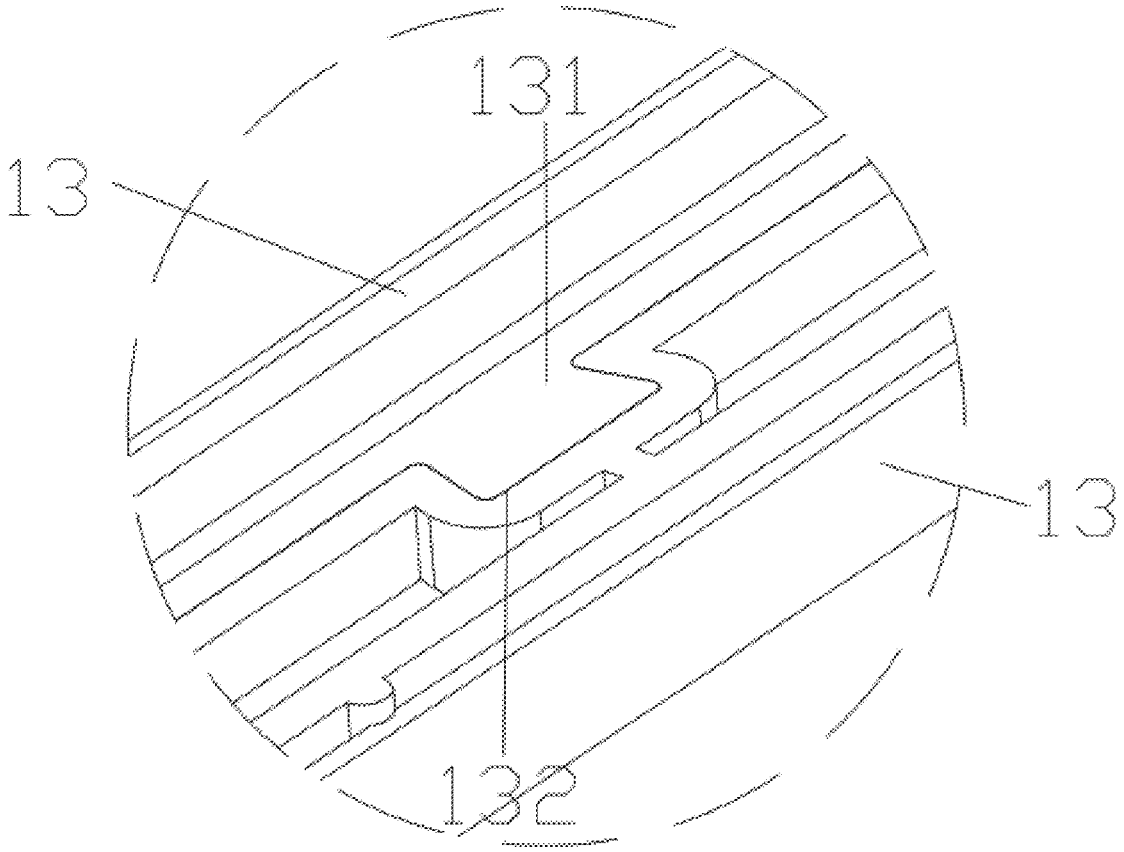
FIG. 9 is an enlarged view of position A in FIG. 8.
Figure 10:
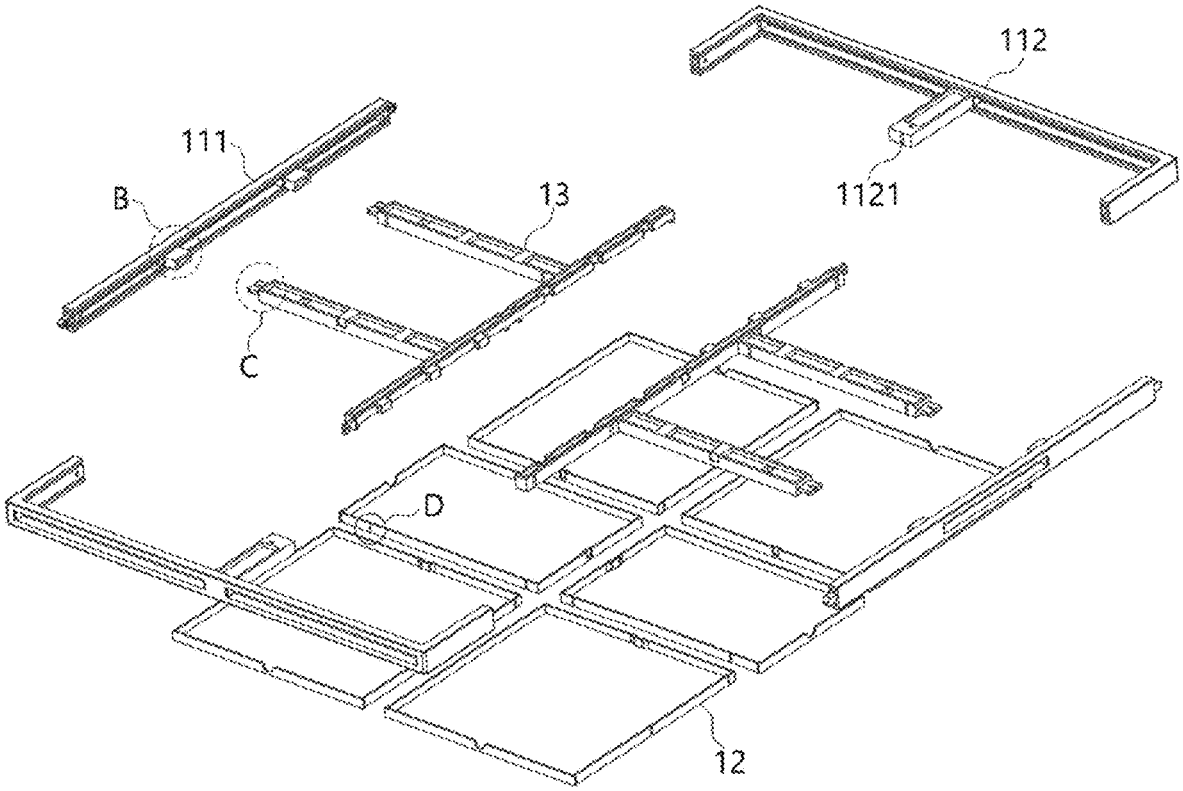
FIG. 10 is an exploded view of FIG. 8.
Figure 11:
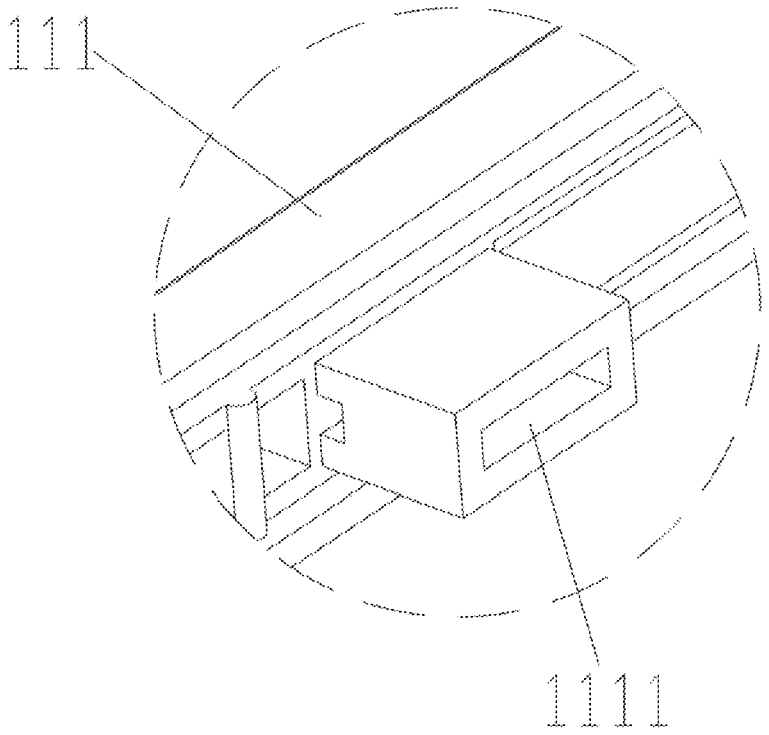
FIG. 11 is an enlarged view of position B in FIG. 10.
Figure 12:
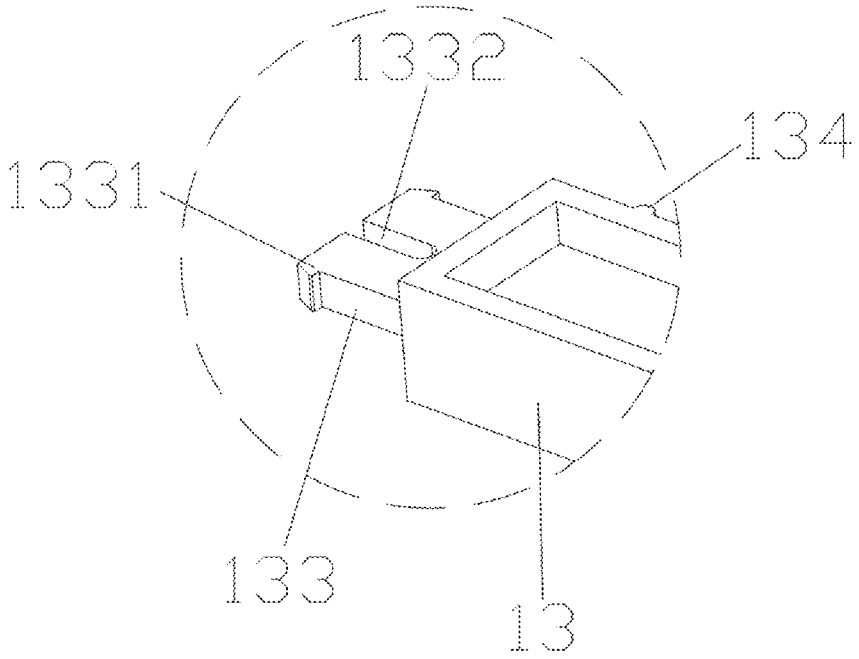
FIG. 12 is an enlarged view of position C in FIG. 10.
Figure 13:
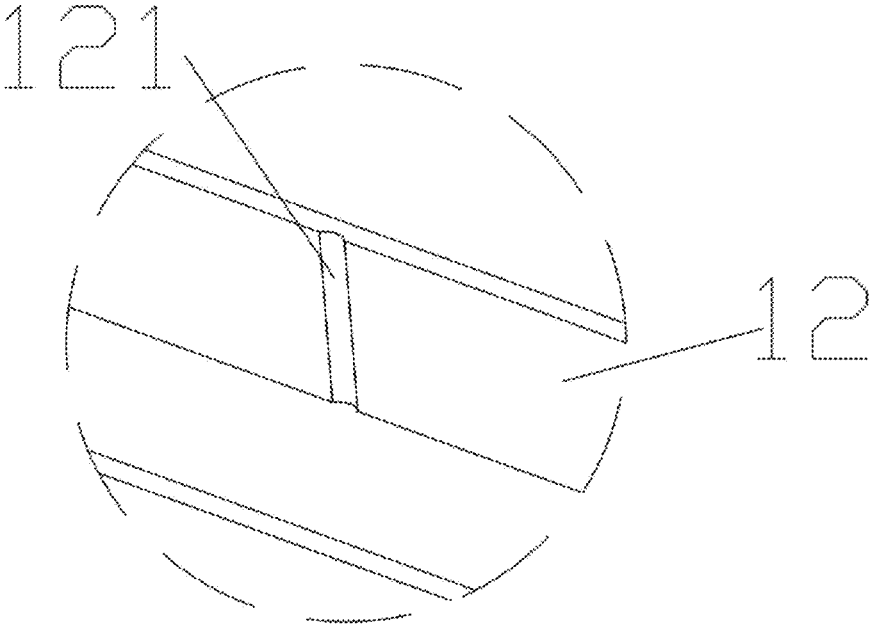
FIG. 13 is an enlarged view of position D in FIG. 10.

Numeral reference: 10—puzzle board, 11—frame, 111—First side rod, 1111—support frame insertion hole, 112—second side rod, 12—drawer board, 121—drawer board positioning groove, 13—support frame unit, 13*a*—ring frame, 13*b*—support frame connection rod, 131—clamp block, 132—clamp slot, 133—support frame insertion rod, 1331—locking block, 1332—compression notch, 134—drawer board positioning block, 20—rotatable base, 21—support plate, 211—through hole, 212—hollow part, 22—contact plate, 221—anti-slip block, 222—anti-slip block installation groove, 223—bearing, 224—rotation shaft, 23—support component, 231—support seat, 232—installation plate, 233—Fixed bolt, 234—rotating ball, 24—support plate bottom surface, 25—contact component socket, 26—reinforcement rib, 27—bearing installation hole, 30—suction hole.

DESCRIPTION OF EMBODIMENTS

In order to enable those skilled in the art to better understand the technical solution of the present application, the following will provide a clear and complete description of the technical solution in the embodiments of the present application in combination with the accompanying drawings. Obviously, the described embodiments are only a part of the embodiments of the present application, not all of them. Based on the embodiments in the present disclosure, all other embodiments obtained by those skilled in the art without creative work fall within the protection scope of the present application.

As shown in FIGS. 1-13, a rotatable puzzle board includes a puzzle board 10, one side of the puzzle board 10 is provided with a rotatable base 20, which includes a support plate 21, a contact component, and a support component 23. The support plate 21 is provided with a contact component socket 25. The contact component includes a contact plate 22, one side of the contact plate 22 extends downwards with a rotation shaft 224, the rotation shaft 224 is located in the contact component socket 25, the contact plate 22 in contact with the puzzle board 10, and the contact component is rotatably connected with the support plate 21. The support component 23 is located on the support plate 21, the support plate 21 includes a support seat 231 and a rotating ball 234 located on the support seat 231 that can rotate at any angle. The rotating ball 234 is in contact with the puzzle board 10, where the rotating ball 234 supports the puzzle board 10. In addition, when the puzzle board 10 rotates, a bottom of the puzzle board 10 slides relative to the rotating ball 234, rendering it smoother for the puzzle board 10 to rotate. This technical solution by providing with the contact component on the support plate 21 and the contact component being connected with the puzzle board 10 so that the puzzle board 10 is rotatably connected with the support plate 21, a user can adjust a position of the puzzle board at any time and can complete puzzles at various angles on the puzzle board without walking, rendering it convenient to use.

In an implementation, the support plate 21 is provided with a bearing installation hole 27, and the bearing installation hole 27 is provided with a bearing 223. The rotation shaft 224 on the contact plate 22 passes through the bearing 223 and is fixed in the contact component socket 25, rendering a rotation between the contact component and the support plate 21 to be smoother.

In addition, a plurality of hollow parts 212 are provided on the support plate 21, a rear side of the support plate 21 is provided with interlocking reinforcement ribs 26, which can reduce the weight of the support plate 21 and improve its strength.

In an implementation, the contact plate 22 is provided with an anti-slip block 221, which is located on one side where the contact plate 22 contacts the puzzle board 10. The anti-slip block 221 can increase a friction coefficient between the puzzle board 10 and the contact plate 22, avoiding sliding between the puzzle board 10 and the contact plate 22. In addition, the contact plate 22 is provided with an anti-slip block installation groove 222 configured to place the anti-slip block 221. The anti-slip block installation groove 222 is configured to position the anti-slip block 221 and prevent the anti-slip block 221 from moving relative to the contact plate 22.

In an implementation, one side of the support seat 231 is provided with an installation plate 232, and a through hole 211 is provided on the support plate 21. The support seat 231 is fixedly connected to the support plate 21 through the installation plate 232, and by drilling holes on the installation plate 232 and by a fixed bolt 233 passing through the installation plate 232 and fixed to a support plate bottom surface 24, the rotating ball 234 passes through the through hole 211 and comes into contact with the puzzle board 10.

In an implementation, the puzzle board 10 includes a frame 11 and a support frame provided within the frame 11, where the support frame includes a plurality of detachable connected support frame units 13, where each support frame unit 13 is provided with a clamp block 131 and a clamp slot 132. Adjacent support frame units 13 are detachably connected through the clamp block 131 in combination with the clamp slot 132, and the clamp blocks 131 and clamp slots 132 on the interconnected support frame units 13 are staggered. Same support frame units 13 can be used for staggered installation, reducing the number of molding spare parts and reducing a production cost. In addition, the support frame is decomposed into a plurality of support frame units 13. It can reduce the volume of the support frame, thereby reducing the cost of warehousing and transportation.

In an implementation, a plurality of drawer boards 12 are provided between the frame 11 and the support frame. One side of each drawer board 12 is provided with a drawer board positioning groove 121, and the support frame is provided with a drawer board positioning block 134. When the drawer board 12 extends and retracts, it is fixed to the drawer board positioning block 134 through the drawer board positioning groove 121 to prevent the puzzle board 10 from extending outward when it moves. There are several extraction holes on the frame 11 for the drawer board 12 to be drawn out, and the drawer board 12 is provided with a groove configured to place the puzzle blocks. When in use, the drawer board is used as a drawer to facilitate a storage of puzzle blocks.

In an implementation, the frame 11 includes a first side rod 111 and a second side rod 112. The first side rod 111 and the second side rod 112 can be detachably connected to form a closed frame 11. Configuring the frame 11 as the first side rod 111 and the second side rod 112 that can be connected to each other can reduce the volume of the frame 11 and thereby reduce the cost of warehousing and transportation.

In an implementation, the first side rod 111 and the second side rod 112 are connected in an insertion manner, and the support frame units 13 are inserted into the frame 11.

In an implementation, an inner side of the frame 11 is provided with a support frame insertion hole 1111, a connection end between the support frame and the frame 11 is provided with a support frame insertion rod 133. Two sides of the support frame insertion rod 133 are provided with a locking block 1331, a compression notch 1332 is provided on the support frame insertion rod 133. When the support frame is fixed on an inner side of the frame 11, the support frame insertion rods 133 are inserted into the support frame insertion hole 1111. By providing with the locking block 1331, the support frame insertion rod 133 is stably connected to the support frame insertion hole 1111. When disassembling, by pressing the locking block 1331, the locking blocks 1331 on both sides are pressed towards the compression notch 1332, the support frame insertion rod 133 is bent and detached from the support frame.

Figure 14:
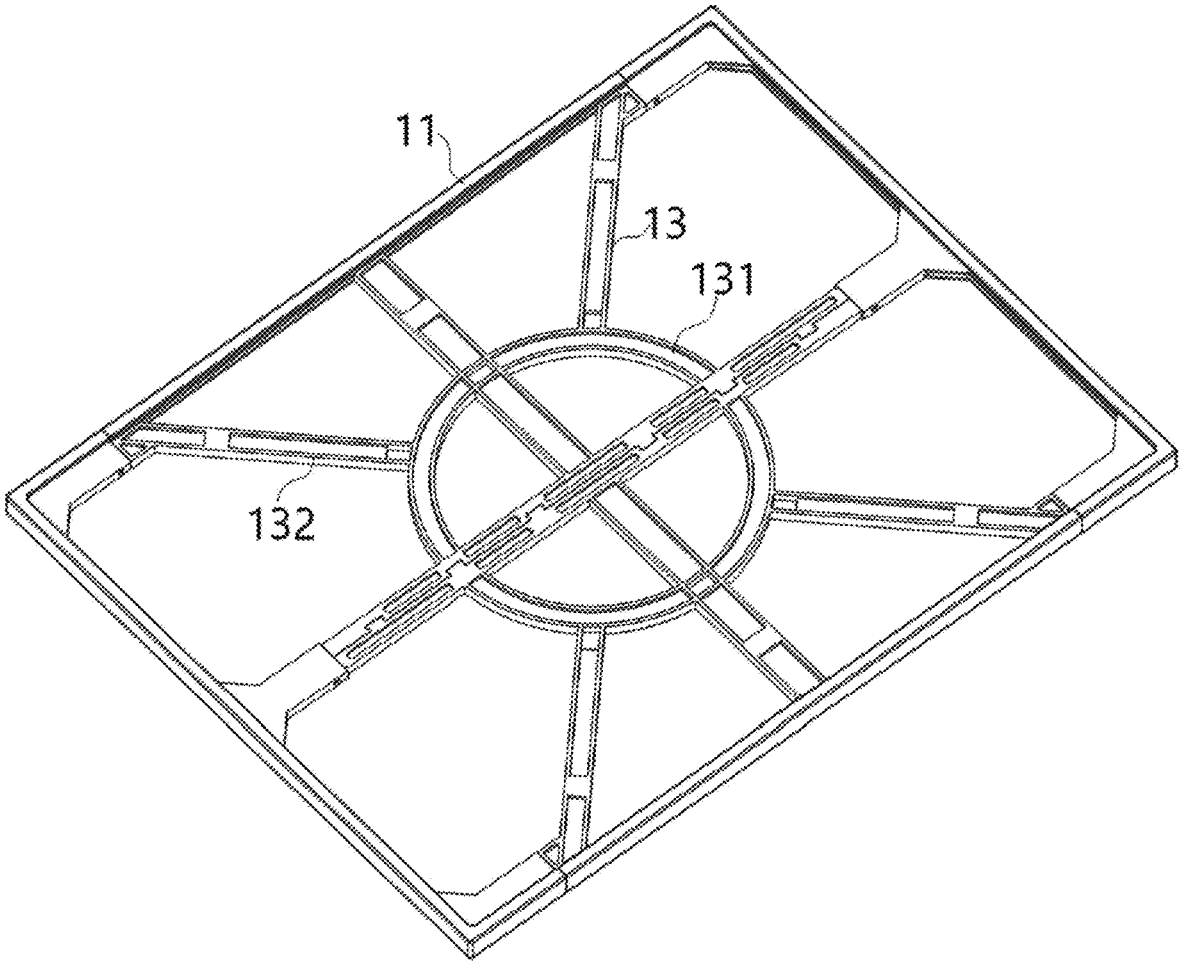
FIG. 14 is a third three-dimensional diagram of the puzzle board in the rotatable puzzle board of the present disclosure.

As shown in FIG. 14, a center end of the support frame is provided with a ring frame 13*a*, and a support frame connection rod 13*b* is provided between the ring frame 13*a* and four corners of the frame 11. The ring frame 13*a* is connected with the support frame to enhance a support strength of the support frame.

From the above description, it can be seen that the embodiments of the present disclosure achieve the following technical effects.

A rotatable puzzle board is provided, which includes a puzzle board, one side of the puzzle board is provided with a rotatable base, the rotatable base includes a support board, a contact component, and a support component. The support board is provided with a contact component socket, and the contact component includes a contact board. One side of the contact component extends downwards with a rotation shaft, the rotation shaft is located in the contact component socket. The contact board contacts with the puzzle board, and the contact component is rotatably connected to the support board. The support component is located on the support board, and the support component includes a support seat and a rotating ball located on the support seat and can rotate at any angle. The rotating ball contacts the puzzle board. The technical solution provides a contact component that is rotationally connected on the support board, and the contact component is connected to the puzzle board so that the puzzle board is rotatably connected to the support plate, a user can adjust the position of the puzzle board at any time and can complete puzzles at various angles on the puzzle board without moving, rendering it convenient to use.

It should be noted that terms used herein are only for describing specific embodiments, and are not intended to limit exemplary embodiments according to the present application. As used herein, unless otherwise explicitly stated in this specification, the singular form is also intended to include the plural form. In addition, it should be understood that when terms "including" and/or "include" are used in this specification, they indicate an existence of features, steps, operations, devices, components, and/or their combinations.

Unless otherwise specified, a relative arrangement, numerical expression, and numerical value of the components and steps described in these embodiments do not limit the scope of the present application. At the same time, it should be understood that for ease of description, dimensions of each part shown in the attached drawings are not drawn according to an actual proportional relationship. The technology, methods, and equipment known to ordinary technical personnel in the relevant field may not be discussed in detail, but in an appropriate case, such technology, methods, and equipment should be considered as part of this specification. In all the examples shown and discussed here, any specific value should be interpreted as merely illustrative and not as a limitation. Therefore, other examples of exemplary embodiments may have different values. It should be noted that similar labels and letters represent similar terms in the following drawings, so once a term is defined in one drawing, it does not need to be further discussed in subsequent drawings.

In the description of the present application, it should be understood that directional words such as "front", "back", "up", "down", "left", "right", "horizontal", "longitudinal", "vertical", "upright", "transverse", and "top", "bottom" indicate that a directional or positional relationship is usually based on the directional or positional relationship shown in the drawings, only for a convenience of describing the present application and simplifying the description. In the absence of contrary explanations, these directional words do not indicate or imply that the device or component referred to must have a specific orientation or be constructed and operated in a specific orientation, and therefore cannot be understood as a limitation on the protection scope of the present application. In addition, the directional words "inner and outer" refer to inner and outer contours relative to each component itself.

It should be understood that when a component is referred to as "on" or "connected to" another component, it can be directly connected to or on that other component, or indirectly connected with an inserted component between the two. On the contrary, when a component is referred to as "directly" on another component or "directly connected" to another component, there is no inserted component between the two.

In addition, it should be noted that in the description of the present disclosure, the use of words such as "first" and "second" to define the components is only for a purpose of distinguishing the corresponding components. If not otherwise stated, the above words do not have special meanings and cannot be understood as limiting the protection scope of the present application. In the description of the present disclosure, unless otherwise specified, the meaning of "multiple" refers to two or more.

The above is the preferred embodiment of the present disclosure. It should be noted that for ordinary technical personnel in this field, several improvements and embellishments can be made without departing from the principles of the present disclosure. These improvements and embellishments are also considered as the protection scope of the present disclosure.

What is claimed is:

1. A rotatable puzzle board, comprising a puzzle board, wherein one side of the puzzle board is provided with a rotatable base, and the rotatable base comprises:

a support plate provided with a contact component socket;

a contact component comprising a contact plate, one side of the contact plate extends downwards with a rotation shaft, the rotation shaft is located in the contact component socket, the contact plate in contacted with the puzzle board, and the contact component in rotatably connected to the support plate;

a support component, wherein the support component is located on the support plate and comprises a support seat and a rotating ball located on the support seat and be capable of rotating at any angle, and the rotating ball is contacted with the puzzle board;

wherein a bearing installation hole is provided on the support plate, and a bearing is provided in the bearing installation hole; the rotation shaft on the contact plate passes through the bearing and is fixed in the contact component socket;

wherein an anti-slip block is provided on the contact plate, and the anti-slip block is located on one side of the contact plate that contacts with the puzzle board;

wherein one side of the support seat is provided with an installation plate, and the support plate is provided with a through hole; the support seat is fixedly connected to the support plate through the installation plate, and the rotating beads pass through the through hole and come into contact with the puzzle board.

2. The rotatable puzzle board according to claim 1, wherein the puzzle board comprises a frame and a support frame provided within the frame, wherein the support frame comprises a plurality of support frame units that are detachable connected, wherein the support frame units are provided with a clamp block and a clamp slot, and adjacent support frame units are detachably connected through the clamp block in conjunction with the clamp slot.

3. The rotatable puzzle board according to claim 2, wherein a plurality of drawer boards are provided between the frame and the support frame, and a side of each drawer board is provided with a drawer board positioning groove; the support frame is provided with a drawer board positioning block, and the frame is provided with a suction hole configured to draw the drawer boards.

4. The rotatable puzzle board according to claim 3, wherein the frame comprises a first side rod and a second side rod, wherein the first side rod and the second side rod are detachably connected to form a closed frame.

5. The rotatable puzzle board according to claim 4, wherein the first side rod and the second side rod are connected in an insertion manner, and the support frame units are inserted into the frame.

6. The rotatable puzzle board according to claim 5, wherein an inner side of the frame is provided with a support frame insertion hole, and a connection end between the support frame and the frame is provided with a support frame insertion rod; two sides of the support frame insertion rod are provided with a locking block, and a compression notch is provided on the support frame insertion rod; when the support frame is fixed on an inner side of the frame, the support frame insertion rod is inserted into the support frame insertion hole.

7. The rotatable puzzle board according to claim 2, wherein a center end of the support frame is provided with a ring frame, and a support frame connection rod is provided between the ring frame and four corners of the frame.

* * * * *